US007176162B2

(12) United States Patent
Kamikawa

(10) Patent No.: US 7,176,162 B2
(45) Date of Patent: Feb. 13, 2007

(54) HEAT-SENSITIVE RECORDING MATERIAL

(75) Inventor: Hiroshi Kamikawa, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 112 days.

(21) Appl. No.: 10/743,713

(22) Filed: Dec. 24, 2003

(65) Prior Publication Data

US 2004/0186019 A1 Sep. 23, 2004

Related U.S. Application Data

(63) Continuation-in-part of application No. 10/395,278, filed on Mar. 25, 2003.

(30) Foreign Application Priority Data

Mar. 26, 2002 (JP) ..... 2002-085657
Dec. 26, 2002 (JP) ..... 2002-377026

(51) Int. Cl.
*B41M 5/28* (2006.01)

(52) U.S. Cl. ..... 503/215

(58) Field of Classification Search ..... 503/200–226
See application file for complete search history.

(56) References Cited

U.S. PATENT DOCUMENTS 5,525,571 A * 6/1996 Hosoi ..... 503/200

FOREIGN PATENT DOCUMENTS

JP 08-156421 A 6/1996
JP 2000-233574 A 8/2000

* cited by examiner

*Primary Examiner*—Bruce H. Hess
(74) *Attorney, Agent, or Firm*—Sughrue Mion, PLLC

(57) ABSTRACT

The present invention provides a heat-sensitive recording material including a support having disposed thereon a heat-sensitive recording layer containing microcapsules in which an electron-donating dye precursor is encapsulated and outside which an electron-accepting compound is present, the electron-donating dye precursor being capable of reacting with the electron-accepting compound to develop color, wherein the microcapsules include at least two kinds of microcapsules having mutually different volume average particle diameters or different glass transition temperatures. A difference between each of the glass transition temperatures of the at least two microcapsules having different glass transition temperatures is preferably in a range from 20° C. to 70° C. According to the invention, a heat-sensitive recording material, which is superior in the reproduction of the gradation of an image and enables recording at high density, is obtained.

20 Claims, No Drawings

HEAT-SENSITIVE RECORDING MATERIAL

CROSS-REFERENCE TO RELATED APPLICATIONS

This application is a Continuation-in-Part of co-pending U.S. patent application Ser. No. 10/395,278 filed on Mar. 25, 2003, the entire disclosure of which is incorporated herein by reference. U.S. patent application Ser. No. 10/395,278 claims priority from Japanese Patent Application No.2002-85657, filed on Mar. 26, 2002. This application also claims priority under 35 USC 119 from Japanese Patent Application No. 2002-377026, the disclosure of which is incorporated by reference herein.

BACKGROUND OF THE INVENTION

1. Field of the Invention

The present invention relates to a heat-sensitive recording material, and, particularly, to a heat-sensitive recording material which is superior in the reproduction of gradation and enables recording at high density.

2. Description of the Related Art

The heat-sensitive recording method has the following advantages: (1) developing is unnecessary; (2) when the substrate is paper, paper quality is close to that of general paper; (3) the handling thereof is easy; (4) developed color density is high; (5) the recording device is simple and inexpensive; and (6) this method is free from noises when recording. Therefore, the application of the heat-sensitive recording has spread to the fields of facsimiles and printers and the fields of labels such as POS.

With this background, transparent heat-sensitive recording materials enabling direct recording using a thermal head have been recently developed for the purposes of coping with a trend toward multi-coloration and projecting an image by using an overhead projector (OHP) and observing an image directly on a light table, and demands with respect to the quality of an image are increasing on one hand. On the other hand, a rise in color development against printing energy tends to be acute as a progress in the high-sensitization of heat-sensitive recording materials is made corresponding to high speed recording, an impression that the gradation of an image has been sacrificed.

In view of this, in order to attain the compatibility of sensitivity with gradation, a heat-sensitive recording material has been developed in which a second color developing layer and a first color developing layer having the same developed color tone as the second color developing layer and laminated on the second color developing layer are laminated on a substrate and the first color developing layer is made to develop a color at a lower temperature than the second color developing layer (Japanese Patent Application Publication (JP-B) No. 6-30953). This invention gives priority to the color development of the first layer in low temperature printing and makes use of color development of the second color developing layer in high temperature printing, however, it possesses the problem that only insufficient image density can be obtained.

Another heat-sensitive recording material has been proposed which contains a water-soluble resin (polyvinyl alcohol) and a solubilizing auxiliary and comprises two heat-sensitive layers including two kinds of capsules (see, e.g., Japanese Patent Application Laid-Open (JP-A) No. 2000-280619). However, since the two kinds of capsules have the same average particle diameter (0.70 μm) in this material, improvement of both color density and gradation reproducibility is insufficient. Still another heat-sensitive recording material has been proposed which contains stearic acid amide in a protective layer and comprises two heat-sensitive layers including two kinds of capsules (see, e.g., JP-A No. 2002-67500). However, since the two kinds of capsules have the same average particle diameter (0.35 μm) in this material, improvement of both color density and gradation reproducibility is still insufficient.

SUMMARY OF THE INVENTION

It is an object of the present invention to solve the aforementioned various prior art problems and to provide a heat-sensitive material which is superior in the reproduction of the gradation of an image and which can obtain high we density.

It is another object of the present invention to solve the problems of the prior art and ride a heat-sensitive recording material that is excellent in image gradation reproducibility and capable of producing high image density.

The above problem can be solved by providing the following recording material.

Accordingly, one aspect of the invention provides a heat-sensitive recording material comprising a substrate; and at least two heat-sensitive recording layers provided on the substrate, the heat-sensitive recording layers including microcapsules encapsulating an electron-donating dye precursor, and an electron-accepting compound, which reacts with the electron-donating dye precursor to develop a color and is disposed outside of the microcapsules, wherein the microcapsules include at least two kinds of microcapsules having different glass transition temperatures.

Also, another aspect of the invention provides a heat-sensitive recording material, wherein a difference between each of the glass transition temperatures of the at least two microcapsules having different glass transition temperatures is in a range from 20° C. to 70° C.

Also, still another aspect of the invention provides a heat-sensitive recording material, wherein the heat-sensitive recording layer includes at least a heat-sensitive recording layer, in which a mass component ratio of microcapsules with a high glass transition temperature to microcapsules with a low glass transition temperature is from 85:15 to 55:45, and a heat-sensitive recording layer, in which a mass component ratio of microcapsules with a high glass transition temperature to microcapsules with a low glass transition temperature is from 20:80 to 50:50.

Further, the invention provides a heat-sensitive recording material which comprises a support having disposed thereon a heat-sensitive recording layer including microcapsules in which an electron-donating dye precursor is encapsulated and outside which an electron-accepting compound is present, the electron-donating dye precursor being capable of reacting with the electron-accepting compound to develop color, wherein the microcapsules comprise at least two kinds of microcapsules having different volume average particle diameters.

DETAILED DESCRIPTION OF THE INVENTION

A heat-sensitive material according to the present invention comprises at least two heat-sensitive recording layers provided on the substrate, the heat-sensitive recording layers including microcapsules encapsulating an electron-donating dye precursor, and an electron-accepting compound, which reacts with the electron-donating dye precursor to develop a color and is disposed outside of the microcapsules, wherein the microcapsules include at least two kinds of microcapsules having different glass transition temperatures. Also, in the heat-sensitive recording material to be provided in the invention, a difference between each of the glass transition temperatures of the at least two microcapsules having different glass transition temperatures is preferably in a range from 20° C. to 70° C. Also, the heat-sensitive recording layers preferably include at least a heat-sensitive recording layer, in which a mass component ratio of microcapsules with a high glass transition temperature to microcapsules with a low glass transition temperature is from 85:15 to 55:45, and a heat-sensitive recording layer, in which a mass component ratio of microcapsules with a high glass transition temperature to microcapsules with a low glass transition temperature is from 20:80 to 50:50.

Further, a heat-sensitive recording material according to the present invention is a recording material which comprises a support having disposed thereon a heat-sensitive recording layer including microcapsules in which an electron-donating dye precursor is encapsulated and outside which an electron-accepting compound is present, the electron-donating dye precursor being capable of reacting with the electron-accepting compound to develop color, wherein the microcapsules comprise at least two kinds of microcapsules having different volume average particle diameters. It is more preferable if the heat-sensitive recording material of the invention comprises two or more heat-sensitive recording layers, each including at least two kinds of microcapsules which are mutually different in volume average particle diameter.

The volume average particle diameter of the microcapsules as used herein refers to a 50% volume average particle diameter as determined by a laser diffraction/scattering method. More specifically, the volume average particle diameter of the microcapsules refers to an average particle diameter that corresponds to a 50% cumulative distribution in the emulsified dispersion, and is determined using a laser diffraction/scattering particle site distribution measuring instrument LA700 (manufactured by Horiba, Ltd.), and hereinafter is sometimes referred to as "volume average particle diameter" or simply as "average particle diameter" or "particle diameter".

With the heat-sensitive recording material of the invention, since the microcapsules encapsulating the electron-donating dye precursor comprise at least two kinds of microcapsules having different volume average particle diameters, a change in density relative to applied energy may be reduced and excellent image gradation may be possessed while maintaining high density. If the heat-sensitive recording material has two or more heat-sensitive recording layers, it can provide further improvements in image density and gradation.

Hereinafter, the heat-sensitive recording material of the invention is described in more detail.

Microcapsule

Generally, a microcapsule encapsulates a diazo compound or an electron-donating dye precursor and the wall of the capsule is made of a polymer obtained by the polymerization of a polyfunctional isocyanate compound. As known polyfunctional isocyanate compounds, descriptions in, for example, Japanese Patent Application Laid-Open (JP-A) No. 10-114153 may be served as references.

When forming the microcapsules, the polyfunctional isocyanate compound is polymerized preferably by causing a reaction with a compound having two or more active hydrogen atoms in the molecule thereof. Examples of the compound having active hydrogen atoms include water, polyvalent alcohol compounds such as ethylene glycol and glycerin, polyvalent amine compounds such as ethylene diamine and diethylene triamine, and mixtures thereof. When causing polymerization, water is particularly preferably used among the above-listed examples, but combinations of water with alcohols or amines may be used as necessary. As a result of this polymerization, the capsule wall comprising the polymer film made of polyurethane and/or polyurea is formed.

For formation of such microcapsules, use may be made of methods such as an interfacial polymerization method, an internal polymerization method and an external polymerization method, among which the interfacial polymerization method which involves emulsifying a core material containing a color forming agent (electron-donating dye precursor) in an aqueous solution of a water-soluble polymer and then forming walls made of a polymeric material around the resulting oil droplets is preferable used. A reactant that forms the polymeric material is added to an inside and/or outside of the oil droplets. The method of forming the microcapsule wall is detailed in, e.g., JP-A No. 58-66948.

Hereinafter, a specific process of forming the microcapsules of the invention is described.

A solution of a color-forming composition (an oil phase) prepared by dissolving the electron-donating dye precursor as a color-forming component in a water-sparingly-soluble or water-insoluble high-boiling organic solvent is added to an aqueous polymer solution (an aqueous phase) containing a surfactant and/or a water-soluble polymer as a protective colloid, then stirred at a high number of revolutions using a high-speed agitator such as a homogenizer to reduce the particle diameter of the oil droplets containing the color-forming composition to several pun or less (preferably 2 μm or less) to be dispersed in the aqueous phase, whereby an emulsion of the color-forming composition is obtained. If necessary, a surfactant, a dispersion stabilizer, an aggregation inhibitor, a water-soluble polymer and a low-boiling solvent may be added as an additive or an auxiliary.

Representative examples of the water-sparingly-soluble or water-insoluble high-boiling organic solvent include phosphates, phthalates, acrylates, methacrylates, other carboxylates, fatty acid amides, alkylated biphenyl, alkylated terphenyl, chlorinated paraffin, alkylated naphthalene, diallylethane, compounds which are solid at ordinary temperatures, oligomer oil and polymer oil.

Specific examples of the organic solvents are described in JP-A Nos. 59-178451 to 59-178455, 59-178457, 60-242094, 63-85633, 6-194825, 7-13310, 7-13311, 9-106039 and 63-45084. Among the solvents described in these specifications, acetates such as ethyl acetate and isopropyl acetate may preferably be used.

When the electron-donating dye precursor to be emulsified is low in solubility in the above organic solvent, a low-boiling organic solvent in which the precursor is highly soluble may simultaneously be used as an aid. The low-boiling organic solvent includes, for example, ethyl acetate, propyl acetate, isopropyl acetate, butyl acetate and methylene chloride.

A total amount of the high-boiling and low-boiling organic solvents is preferably 1 to 500 parts by mass, based on 100 parts by mass of an electron-donating dye precursor composition.

As the aqueous phase to serve as a medium of the emulsified dispersion, an aqueous solution of a water-soluble polymer is used. The water-soluble polymer facilitates to form a uniform dispersion and simultaneously serves as a dispersing medium and a colloid-protecting agent, whereby aggregation of the aqueous emulsified dispersion is prevented to thus stabilize the dispersion.

The water-soluble polymer may be selected suitably from known anionic polymers, nonionic polymers and amphoteric polymers.

The anionic polymer used may be either of a naturally occurring or synthetic anionic polymer such as a polymer having a —COO— group, a —$SO_2$— group, etc.

Specific examples include naturally occurring polymers such as gum arabic, alginic acid and pectic acid; gelatin derivatives such as carboxymethyl cellulose and phthalated gelatin; semi-synthetic products such as sulfated starch, sulfated cellulose and ligninsulfonic acid; and synthetic products such as maleic anhydride-type (including hydrolysates) copolymers, acrylic acid-type (methacrylic acid-type) polymers and copolymers, vinylbenzenesulfonic acid-type polymers and copolymers, carboxy-modified polyvinyl alcohol and polyvinyl pyrrolidone.

Examples of the nonionic polymer includes polyvinyl alcohol, hydroxyethyl cellulose and methyl cellulose. The amphoteric polymer includes gelatin.

Among the water-soluble polymers described above, gelatin, modified gelatin derivatives, polyvinyl alcohol and polyvinyl alcohol derivatives are preferably used because of their excellent effect.

The water-soluble polymer is used in the form of an aqueous solution having a concentration preferably in the range of 0.01 to 10% by mass.

In order to emulsify and disperse the oil and aqueous phases and uniformly stabilize them, it is preferable to add a surfactant to at least one of the oil phase and the aqueous phase. As the surfactant, a known surfactant for emulsification and dispersion may be used. When the surfactant is added to the oil phase, the amount of the surfactant added is preferably 0.1 to 5% by mass, and more preferably 0.5 to 2% by mass.

As the surfactant contained in the aqueous phase, a surfactant which does not cause problems such as precipitation and aggregation to occur upon reaction with the water-soluble polymer may be selected for use from anionic or nonionic surfactants.

The preferable surfactant for use in the invention includes, for example, sodium alkylbenzenesulfonate, sodium alkylsulfonate, sodium dioctyl sulfosuccinate, polyalkylene glycol (e.g., polyoxyethylene nonyl phenyl ether) etc. Among these surfactants, sodium alkylbenzenesulfonate is particularly preferably used because of its excellent effect.

In order to prepare a finely emulsified dispersion stably, a mixing ratio of the oil phase containing the electron-donating dye precursor composition with the aqueous phase (an oil phase/aqueous phase ratio by mass) is also an important factor. In the invention, the mixing ratio is preferably 0.05 to 1.0, and more preferably 0.3 to 0.8. When the mixing ratio is less than 0.05, the aqueous phase is present in an excessively large amount and hence the dispersion is too dilute to always achieve sufficient color development. When the mixing ratio is higher than 1.0, emulsification suitability is deteriorated, whereby the phenomenon of a so-called phase reversal of an emulsion in which the aqueous phase is emulsified and dispersed in the oil phase may occur, to thereby cause inconvenient handling and deteriorate stability.

As an emulsifying device for dispersing the electron-donating dye precursor composition of the invention in water, known devices employed in emulsification and dispersion of fine particles, such as an agitator capable of high-speed revolution and a supersonic dispersing device, for example emulsifying and dispersing devices such as a homogenizer, Manton-Gaulin, a supersonic dispersing machine, a dissolver and a Kdmill way be used. Among these emulsifying and dispersing devices, the homogenizer is particularly preferably used because of its excellent dispersion efficiency.

Usually, the emulsion containing the electron-donating dye precursor of the invention should be stirred at a high speed sufficient to reduce the diameter of the dispersed particles below several μm. Generally, the number of revolutions should be 5,000 rpm or more depending on the components of a visible-light polymerizable composition and specifications of a stirring machine used, and the emulsion is stirred preferably at 10,000 rpm or more at a final stage of emulsification. The upper limit of the number of revolutions is predetermined to avoid an excessive increase in a temperature of the emulsion.

The diameter of the dispersed particles in the emulsion containing the electron-donating dye precursor of the invention is preferably 2 μm or less, and more preferably 1 μm or less. When the diameter of the dispersed particles is greater than 2 μm, the desired density of developed color way not be obtained. However, when the diameter of the dispersed particles is too small, emulsifying and dispersing operation is difficult to conduct, and the emulsion does not have shelf storability. Thus, the particle diameter of the dispersed particles is desirably 0.05 μm or more.

In the heat-sensitive recording material of the invention, the microcapsules containing the electron-donating dye precursor comprise at least two kinds of microcapsules having different volume average particle diameters. The volume average particle diameter of the microcapsules can be controlled by suitably specifying conditions such as (1) characteristics of the oil phase containing the electron-donating dye precursor (concentration, viscosity, surface tension, dissolving difficulty in the aqueous phase, etc.); (2) characteristics of the aqueous phase containing the water-soluble polymer serving as a dispersing medium (concentration, viscosity, surface tension, compatibility with the oil phase, etc.); (3) the mixing ratio of the oil phase with the aqueous phase by mass; and (4) conditions for mixing the aqueous phase with the oil phase (stirring device, stirring rate, stirring temperature, stirring procedure, etc.) in the process of preparing an emulsified dispersion containing the electron-donating dye precursor, and thus the microcapsules of the desired volume average particle diameter may be obtained.

It is usual that the particle diameter of the microcapsules tends to become smaller when (1) the oil phase has a low concentration, a low viscosity and a low surface tension and is hardly soluble in the aqueous phase; when (2) the aqueous phase has a low concentration, a low viscosity and a low surface tension and is poor in compatibility with the oil phase; when (3) the mixing ratio of the oil phase with the aqueous phase by mass is low; and when (4) the stirring efficiency or the stirring rate is high or the stirring temperature is low.

However, the aforementioned relationships between the particle diameter of the microcapsules and the phase conditions are generally described, and hence should be taken into account depending on the type and properties of the color forming agent, organic solvent, water-soluble polymer and surfactant to be used, and further the conditions should be determined suitably in consideration of the stability, shelf stability and productivity of the emulsified dispersion.

The volume average particle diameter of the microcapsules may be controlled in some cases by regulating an addition amount of the polyvalent alcohol compound or polyvalent amine compound to cause polymerization of the polyfunctional isocyanate compound, a time point for adding it, a reaction temperature and a reaction duration. However, there is a restriction to the upper limit of the effective amount, the reaction temperature and the reaction duration, and thus the particle diameter is desirably controlled by selecting the above-mentioned components and a process, etc.

As described above, at least two kinds of microcapsules having different volume average particle diameters may arbitrarily be used to form a heat-sensitive recording layer. It is preferable from the viewpoint of attaining gradation reproducibility and high density recording that the heat-sensitive recording material of the invention comprises two or more heat-sensitive recording layers each containing at least two kinds of microcapsules having different volume average particle diameters.

It is more preferable from the viewpoint of further improving gradation reproducibility and high density recording that a difference in volume average particle diameter between the two or more kinds of microcapsules having different volume average particle diameters is preferably 0.3 to 0.7 μm, more preferably 0.4 to 0.65 μm, and further more preferably 0.45 to 0.6 μm.

In particular, a heat-sensitive recording material containing a heat-sensitive recording layer whose mass ratio (x/y) of a microcapsule (x) having a larger volume average particle diameter to another microcapsule (y) having a smaller volume average particle diameter is 85/15 to 55/45 and another heat-sensitive recording layer whose mass ratio (x/y) is 20/80 to 50/50 is most preferable, because such a heat-sensitive recording material can sufficiently exert an effect resulting from a difference in the particle diameter and reproduce excellent image gradation, without applying high amounts of energy. Further, the microcapsule (x) having a larger volume average particle diameter has a volume average particle diameter preferably of 0.50 to 1.50 μm, and more preferably of 0.70 to 0.90 μm, while the microcapsule (y) having a smaller volume average particle diameter has a volume average particle diameter preferably of 0.10 to 0.50 μm, and more preferably of 0.25 to 0.45 μm.

The microcapsules formed in such a manner cannot be destroyed by the action of heat or pressure. When the microcapsule walls are heated at a temperature above a glass transition point, permeability of the walls increases, and the color-forming component contained in microcapsule cores passes through the microcapsule wall, or alternatively, the developing component moves to inside of the microcapsule wall to thereby form color.

In the invention, components which are not encapsulated may be solid-dispersed in a usual manner, but from the viewpoint of enhancing transparency of the heat-sensitive layer and improving image quality, the electron-accepting compound is dissolved in a water-sparingly-soluble or water-insoluble organic solvent, then mixed with the aqueous phase which contains the water-soluble polymer as a protective colloid and optionally includes a surfactant, to be used in the form of an emulsified dispersion.

In the aforementioned microcapsule, the capsule wall is made of the polymer obtained by the polymerization of a polyfunctional isocyanate compound. The polymerization of a polyfunctional isocyanate compound is preferably accomplished by a reaction with, for example, a compound having two or more active hydrogen atoms in its molecule. Examples of the compound having an active hydrogen atoms include, besides water, polyhydric alcohol type compounds such as ethylene glycol and glycerol, polyvalent amine type compounds such as ethylenediamine and diethylenetriamine or mixtures of these compounds. Although it is preferable to use, particularly, water among these compounds to carry out the polymerization, water may be combined with alcohol or amines as needed. As a consequence, a capsule wall (polyurethane/polyurea wall) is formed.

In the present invention, microcapsules having different glass transition temperatures may be used. The microcapsules having different glass transition temperatures may be formed by selecting ordinary capsule-forming materials.

As to the formation of microcapsules having different glass transition temperatures (hereinafter referred to simply as Tg as the case may be), a capsule wall material having a low Tg may be formed using an aliphatic isocyanate, whereas a capsule wall material having a high Tg may be formed using an aromatic isocyanate.

Tg of the capsule wall may also be adjusted by controlling the amount of the polyhydric alcohol or polyvalent amine type compound to be added, reaction temperature and reaction time in the aforementioned polymerization of a polyfunctional isocyanate compound. Tg can be made high by increasing the amount of the polyvalent amine type compound and the like, by raising the reaction temperature and by prolonging the reaction time. However, there is limitation to the effective amount, reaction temperature and reaction time. It is therefore preferable that an adjustment accompanied by a large change in Tg be made by the selection of a proper capsule wall material.

In the invention, microcapsules differing in Tg may be formed using optional capsule wall materials differing in Tg. A difference between each of the Tg of the microcapsules used in the invention is preferably in a range from 20° C. to 70° C. When the difference in Tg is in a range from 20° C. to 70° C., an effect due to the difference in temperature can be sufficiently produced, it is possible to reproduce a high image gradation and also required energy to be applied is not excessively high.

To state a combination of the aforementioned capsule wall materials of microcapsules between which the difference between each of the Tg falls in a range from 20° C. to 70° C., tolylenediisocyanate, diphenylmethanediisocyanate, xylylenediisocyanate and the like are preferable as the wall material having a high glass transition temperature and hexamethylenediisocyanate, isophoronediisocyanate, hydrogenated xylylenediisocyanate and the like are preferable as the wall material having a low glass transition temperature. A combination of tolylenediisocyanate and isophoronediisocyanate among these compounds is particularly preferable.

These capsule wall materials may be used in combinations of two or more.

Also, in the invention, Tg may also be controlled by adding a compound capable of decreasing the glass transition temperature of a microcapsule wall. The above additive is called a sensitizer. As the sensitizer, those which have a melting point of 50° C. or more and preferably 120° C. or less and are solid at ambient temperature may be selected from among plasticizers of a polymer used as the microcapsule wall material and used.

In the case where the wall material is made of, for example, polyurea or polyurethane, carbamate compounds, aromatic alkoxy compounds, organic sulfonamide compounds, aliphatic amide compounds, arylamide compounds, phenol compounds and alcoholic compounds are exemplified. Specific examples of these plasticizers may include compounds such as p-tert-octylphenol, p-benzyloxyphenol, phenyl p-oxybenzoate, benzyl carbanilate, phenethyl carbanilate, hydroquinone dihydroxyethyl ether, xylylene diol, N-hydroxyethyl-methanesulfonic acid amide and N-phenylmethanesulfonic acid amide. These compounds may be contained in the core material or may be added as an emulsion dispersion outside of the microcapsule.

In the production of such a microcapsule, any of an interfacial polymerization method, internal polymerization method and external polymerization method may be adopted. Particularly, it is preferable to adopt an interfacial polymerization method in which a core material containing a color coupler is emulsified in an aqueous solution in which a water-soluble polymer is dissolved and then a wall of a high molecular material is formed on the periphery of the oil droplet. A reactant for forming the high molecular material is added to the inside of an oil droplet and/or the outside of an oil droplet.

The details of a method for the production of a microcapsule complex wall are described in, for example, JP-A No. 58-66948. In the case of making an electron-donating dye precursor which will be explained later into a microcapsule, it is preferable to dissolve the electron-donating dye precursor in an organic solvent when it is used.

As an organic solvent like this, a low-boiling point solvent such as ethyl acetate, methyl acetate, carbon tetrachloride, chloroform, methanol, ethanol, n-butanol, dioxane, acetone and benzene are preferable. Such an organic solvent is described in detail in JP-A No. 4-19778.

A metal-containing dye, a charge regulator such as nigrosine and other additives may be added to the microcapsule wall to be used in the invention as needed. These additives may be added at any time before or when the wall is formed. A vinyl monomer or the like may be added to graft-polymerize the monomer in order to control the charge of the surface of the microcapsule wall.

The microcapsule produced in the above miner is not broken by heat or pressure and has the heat-sensibility control ability that when the wall of the microcapsule is heated to a temperature above its glass transition temperature, the material transmittance of the wall increases and a color-developing component contained in the core and outside of the microcapsule transmits the wall of the microcapsule to develop a color. The glass transition temperature of the wall of the microcapsule may be measured using a known temperature gage used to measure the glass transition temperature of high molecular materials.

In the invention, a component which cannot be made into a microcapsule may be solid-dispersed as usual. It is preferable to use such a component in the form an emulsion dispersion from the viewpoint of improving the transparency of the heat-sensitive layer and bettering image quality; specifically, an electron-accepting compound is dissolved in an organic solvent which is sparingly soluble or insoluble in water and then the obtained solution is mixed with a water phase containing a water-soluble polymer as a protective colloid and, as required, a surfactant, to form an emulsion.

The water-soluble polymer which is to be contained as a protective colloid in a water phase mixed with an oil phase containing these components may be selected from known anionic polymers, nonionic polymers and amphoteric polymers. Among these compounds, particularly polyvinyl alcohols, gelatins and cellulose derivatives are preferable. Also, as the surfactant to be contained in a water phase, a surfactant may be used which is properly selected from anionic or nonionic surfactants and is other than those which react with the aforementioned protective colloid to give rise to precipitation and coagulation. Preferable examples of the surfactant may include sodium alkylbenzenesulfonate, sodium alkylsulfate, dioctylsodium sulfosuucinate and polyalkylene glycol (e.g., polyoxyethylene nonylphenyl ether).

The emulsion dispersion in the invention can be easily obtained by mixing or dispersing an oil phase containing the above components and a water phase containing a protective colloid and further a surfactant as needed using a means, such as high-speed stirring or ultrasonic dispersing, which is used in usual emulsification of microparticles. Also, the ratio of the oil phase to the water phase (oil phase weight/water phase weight) is preferably 0.02 to 0.6 and particularly preferably 0.1 to 0.4. When the ratio is in the range from 0.02 to 0.6, this prevents the occurrence of such phenomena that the volume of the water phase is excessive, so that the system is dilute and only insufficient color developing ability is obtained and that, on the contrary, the viscosity of the solution is high, bringing about inconvenience in handling and a reduction in the stability of a coating solution.

Heat-Sensitive Recording Layer

In an embodiment, the heat-sensitive recording material of the present invention comprises a support having disposed thereon a heat-sensitive recording layer including microcapsules in which an electron-donating dye precursor is encapsulated and outside which an electron-accepting compound is present, the electron-donating dye precursor being capable of reacting with the electron-accepting compound to develop color, wherein the microcapsules comprise at least two kinds of microcapsules having different volume average particle diameters and the material preferably comprises two or more heat-sensitive recording layers each containing at least two kinds of microcapsules having different volume average particle diameters.

It is more preferable that in the heat-sensitive recording material of the invention, at least two kinds of microcapsules having different volume average particle diameters are contained in the heat-sensitive recording layer in a varying ratio to thereby control thermal sensitivity of the layer, such that the two or more heat-sensitive recording layers having different thermal sensitivity can be arranged, and as a result, a density change against applied heat energy can be reduced within a density range that is necessary for forming medical images, thus providing a heat-sensitive recording material excellent in gradation reproducibility.

In an embodiment, the heat-sensitive recording material of the invention comprises, on a substrate, at least two heat-sensitive recording layers-provided on the substrate, the heat-sensitive recording layers including microcapsules encapsulating an electron-donating dye precursor, and an electron-accepting compound, which reacts with the electron-donating dye precursor to develop a color and is disposed outside of the microcapsules, wherein the microcapsules include at least two kinds of microcapsules having different glass transition temperatures. Also, in the heat-sensitive recording material to be provided in the invention, the heat-sensitive recording layers preferably include at least a heat-sensitive recording layer, in which a mass component ratio of microcapsules with a high glass transition temperature to microcapsules with a low glass transition temperature is from 85:15 to 55:45, and a heat-sensitive recording layer, in which a mass component ratio of microcapsules with a high glass transition temperature to microcapsules with a low glass transition temperature is from 20:80 to 50:50.

In the invention, microcapsules having different glass transition temperatures are made to be contained in structural ratios differing from each other to thereby control the heat-sensibility of the heat-sensitive recording layer and two or more heat-sensitive recording layers differing in heat-sensibility are laminated, thereby making it possible to lower a change in density as a function of heat energy to be applied in the density range required for medical images and a heat-sensitive recording material superior in the reproduction of gradation can be thereby formed.

The heat-sensitive layer in the invention will be explained hereinbelow.

Electron-Donating Dye Precursor

As the electron-donating dye precursor, compounds are used which characteristically donates an electron or accepts a proton such as an acid to develop a color and have a partial skeleton of lactone, lactam, sultone, spiropyran, ester, amide or the like, which partial skeleton is ring-opened or cleft when these compounds are brought into contact with an electron-accepting compound used as a developer. Examples of the electron-donating precursor include various electron-donating colorless dye compounds such as phthalide type compounds such as triphenylmethane phthalide and indolyl phthalide, fluoran type compounds, phenothiazine type compounds, leucoauramine type compounds, rhodaminelactam type compounds, triphenylmethane type compounds, triazene type compounds, spirodipyran type compounds, pyridine type compounds, pyrazine type compounds and fluorene type compounds.

Specific examples of the aforementioned phthalide compound include compounds described in U.S. Republished Pat. No. 23,024, U.S. Pat. Nos. 3,491,111, 3,491,112, 3,491,116 and 3,509,174.

Specific examples of the aforementioned fluoran type compound include compounds described in U.S. Pat. Nos. 3,624,107, 3,627,787, 3,641,011, 3,462,828, 3,681,390, 3,920,510 and 3,959,571.

Specific examples of the aforementioned spirodipyran type compound include compounds described in U.S. Pat. No. 3,971,808.

Specific examples of the aforementioned pyridine compound and pyrazine compound include compounds described in U.S. Pat. Nos. 3,775,424, 3,853,869 and 4,246,318.

Specific examples of the aforementioned fluorene type compounds include compounds described in JP-A No. 63-94878.

Electron-Accepting Material

Examples of the electron-accepting material include conventionally known compounds such as phenol derivatives, salicylic acid derivatives, metal salts of aromatic carboxylic acids, acid clay, bentonite, novolac resins, novolac resins treated with metals and metal complexes. Typical examples of these compounds include compounds described in JP-B Nos. 40-9309 and 45-14039, JP-A Nos. 52-140483, 48-51510, 57-210886, 58-87089, 59-11286, 60-76795 and 61-95988.

Specific examples of these compounds include 4-t-butylphenol, 4-phenylphenol, 2,2'-dihydroxybiphenyl, 2,2-bis(4-hydroxyphenyl)propane(bisphenol A), 4,4'-sec-butylidenediphenol, 4,4'-cyclohexylidenediphenol, 4-hydroxyphenyl-3',4'-dimethylphenylsulfone, 4-(4-isopropoxyphenylsulfonyl)phenol, 4,4'-dihydroxydiphenyl sulfide, 1,4-bis-(4'-hydroxycumyl)benzene, 1,3-bis-(4'-hydroxycumyl)benzene, 4,4'-thiobis(6-t-butyl-3-methylphenol), benzyl 4-hydroxybenzoate.

Specific examples also include 3,5-di-t-butylsalicylic acid, 3-phenyl-5-(α,α-dimethylbenzyl)salicylic acid, 3-cumyl-5-t-octylsalicylic acid, 3,5-di-t-butylsalicylic acid, 3-phenyl-5-t-octylsalicylic acid, 3-methyl-5-α-methylbenzysalicylic acid, 3-methyl-5-cumylsalicylic acid, 3,5-di-t-octylsalicylci acid, 3,5-bis(α-methylbenzyl)salicylic acid, 3-cumyl-5-phenylsalicylic acid, 5-n-octadecylsalicilic acid, 4-pentadecylsalicylic acid, 3,5-bis(α,α-dimethylbenzyl)salicylic acid, 3,5-bis-t-octylsalicylic acid, 4-β-dodecyloxyethoysalicylic acid, 4-methosy-6-dodecyloxysalicylic acid, 4-β-phenoxyethoxysalicylic acid, 4-β-p-ethylphenoxyethoxysalicylic acid, 4-β-p-methoxyphenoxyethoxysalicylic acid and metal salts of these compounds.

These compounds may be used either singly or in combinations of two or more.

The amount of the electron-accepting material to be used is preferably 50 to 800% by weight and more preferably 100 to 500% by weight of the electron-donating dye precursor. Even if the amount exceeds 800% by weight, no effect corresponding to the addition of a large amount of the electron-accepting material is obtained. On the other hand, an amount less than 50% by weight brings about insufficient color developing. An amount out of the above range are therefore undesirable.

When the electron-accepting material and the electron-donating dye precursor are compounded as color developing components in an aqueous solution of the aforementioned water-soluble polyvinyl alcohol resin, the electron-accepting material and the electron-donating dye precursor may be compounded simultaneously in the foregoing aqueous solution of the water-soluble polyvinyl alcohol resin or may be respectively compounded in each of the foregoing aqueous solutions of the water-soluble polyvinyl alcohol resin and the obtained two mixed solutions are further mixed with each other. In addition, components such as a color developing adjuvant may be added.

In addition, a heat-meltable material, ultraviolet absorber, pigments, sensitizers, wax, antistatic agent, antifoaming agent, electroconductive agent, fluorescent dyes, surfactants, ultraviolet absorber precursor and the like may be added to the heat-sensitive recording layer corresponding to the use of the heat-sensitive recording material.

Heat-Sensitive Recording Layers Differing in Volume Average Particle Diameter

The heat-sensitive recording layers containing microcapsules having different volume average particle diameters may be formed by adjusting the structural ratio of the aforementioned microcapsules having different volume average particle diameters.

In the case of adjusting the structural ratio of microcapsules having different volume average particle diameters in two or more heat-sensitive recording layers to be formed on the substrate, it is necessary to pay attention to the structural ratio in these heat-sensitive recording layers such that the ratio of a microcapsule having a high volume average particle diameter to a microcapsule having a low volume average particle diameters is 85–55/15–45.

Recording Material Composition

Polyvinyl Alcohol

In the recording material composition in the invention, it is preferable to use a polyvinyl alcohol having an average saponification degree of 95 to 100% and a color difference value YI of 15 or more for a protective layer, an intermediate layer and the like. This is because if the average saponification degree is less than 95%, crystallinity is decreased and barrier characteristics are lowered. The average saponification degree is particularly preferably 95 to 98%.

The polymerization degree of the aforementioned polyvinyl alcohol is preferably in a range from 300 to 3000 with the view of maintaining barrier characteristics and solubility in water. Particularly, a range from 1500 to 2500 is preferable.

Other Components

The recording material composition of the invention may use a wide range of conventionally known materials to the extent that the object of the invention is not impaired. Polyvinyl alcohols other than the above polyvinyl alcohol and modified polyvinyl alcohols such as ethylene-modified polyvinyl alcohols and carboxy-modified polyvinyl alcohols may be used. When the ethylene-modified polyvinyl alcohol is used, the degree of ethylene modification is preferably 1% to 20% and particularly preferably 4% to 12%. When the degree of ethylene modification is less than the above range, water resistance is deteriorated whereas the degree of ethylene modification exceeds the above range, water solubility is deteriorated.

The ethylene-modified polyvinyl alcohol may be further modified by other functional groups to the extent that its characteristics and the stability of a coating solution are not adversely affected. Specific examples of the above other functional groups include a carboxyl group, terminal alkyl group, amino group, sulfonic acid group, terminal thiol group, silanol group and amide group. Among these groups, a carboxyl group-modified sulfonic acid group, amino group-modified sulfonic acid group and the lice are effective from the viewpoint of giving solubility to the ethylene-modified polyvinyl alcohol.

Also, a known water-soluble resin such as vinyl acetate-acrylamide copolymer, silicon-modified polyvinyl alcohol, starch, modified starch, methyl cellulose, ethyl cellulose, carboxymethyl cellulose, hydroxymethyl cellulose, gelatins, gum arabic, casein, styrene-maleic acid copolymer hydrolysate, styrene-maleic acid copolymer half-ester hydrolysate, isobutylene-maleic acid anhydride hydrolysate, polyacrylamide derivative, polyvinylpyrrolidone, sodium polystyrenesulfonate, sodium alginate and the like may be used.

Recording Material

The recording material of the invention comprises two or more heat-sensitive recording layers differing in the structural ratio of microcapsules differing in Tg on a substrate. The provision of two or more heat-sensitive recording layers differing in the structural ratio of microcapsules differing in Tg makes it possible to decrease a change in density as a factor of applied heat energy in the density range required for medical images, whereby a heat-sensitive recording material superior in the reproduction of the gradation of an image can be formed. Because in the case of, particularly, heat-sensitive recording materials for medical use, the reproduction of high gradation is required in a wide density range, the heat-sensitive recording material of the invention may be preferably used.

Further, the heat-sensitive recording material of the invention preferably comprises at least two heat-sensitive recording layers arranged on a support, and the respective heat-sensitive recording layers include microcapsules having different volume average particle diameters in a different ratio. By arranging at least two heat-sensitive recording layers comprising microcapsules having different volume average particle diameters in the different ratio, there may be provided a heat-sensitive recording material in which a density change against applied heat energy can be reduced within a density range that is necessary for forming medical images and thus excellent gradation reproducibility is exhibited. The heat-sensitive recording material of the invention is particularly preferably used in the medical field where excellent gradation reproducibility is required in a wide density range.

The recording material of the invention is preferably provided with an intermediate layer and a protective layer and may be further provided with an undercoat layer, a ultraviolet filter layer and a back layer on the heat-sensitive recording layer.

The heat-sensitive recording layer in the invention is preferably a heat-sensitive recording layer having a wide range of the quantity of energy required to obtain saturated transmitting density (Dt-max), namely a wide dynamic range, to suppress density unevenness caused by a slit difference in the heat conductivity of a thermal head to thereby obtain a high quality image. The heat-sensitive recording material of the invention preferably has a heat-sensitive recording layer such as those aforementioned and the heat-sensitive recording layer preferably has the characteristics enough to obtain a transmission density (Dt-max) of 3.0 at a heat energy quantity ranging from 90 to 150 $mJ/mm^2$. The above heat-sensitive recording layer is preferably applied such that the dry coating amount after the recording layer is applied and dried is 1 to 25 $g/m^2$. Two or more heat-sensitive recording layers may be laminated when used. In this case, it is also preferable to apply such that the dry coating amount of all heat-sensitive recording layers after the recording layers are applied and dried is 1 to 25 $g/m^2$.

Protective Layer

The protective layer is formed on the aforementioned heat-sensitive recording layer or on an intermediate layer in the case of forming the intermediate layer as one of other layers on the heat-sensitive recording layer. The protective layer is formed by applying a protective layer coating solution. No particular limitation is imposed on the pigments which may be used for the protective layer and examples of the pigment may include known organic or inorganic pigments. Specifically, preferable examples include inorganic pigments such as calcium carbonate, titanium oxide, kaolin, aluminum hydroxide, amorphous silica and zinc oxide and organic pigments such as urea formalin resins and epoxy resins. Among these pigments, kaolin, aluminum hydroxide and amorphous silica are particularly preferable. These pigments may be used either singly or in combinations of two or more. Pigments among these pigments may be surface-coated with at least one type selected from the group consisting of higher fatty acids, metal salts of higher fatty acids and higher alcohols. Examples of the higher fatty acids may include stearic acid, palmitic acid, myristic acid and lauric acid.

Examples of adjuvants for dispersing these pigments may include sodium hexamethaphosphate, partially or completely saponified polyvinyl alcohols, polyacrylic acid copolymers and various surfactants. It is preferable to use each of these pigments after it is dispersed using a known dispersing machine such as a dissolver, sand mill or ball mill in the presence of a partially or completely saponified polyvinyl alcohol or polyacrylic acid copolymer among these adjuvants together with an ammonium salt until the 50% volume average particle diameter falls in a range from 0.1 to 5.0 μm.

Surfactants, metal oxide microparticles, inorganic electrolytes, high molecular electrolytes and the like may be added to the aforementioned protective layer for the purpose of imparting antistatic ability to the heat-sensitive recording material.

Substrate

As the substrate, a polyester, particularly, polyethylene terephthalate is preferably used. In the case of a medical use, the transparent substrate may be colored by a blue dye (e.g., the dye-1 described in the Example of JP-A No. 8-240877) or may be non-colored. The substrate is preferably undercoated with a gelatin, a water-soluble polyester or the like. As the undercoat layer, those described in each publication of JP-A Nos. 51-11420, 51-123139 and 52-65422 may be utilized.

Intermediate Layer

The intermediate layer is preferably formed on the heat-sensitive recording layer. The intermediate layer is formed with the intentions of preventing mixing of layers and shutting out gases (e.g., oxygen) harmful to image-preserving ability. There is no particular limitation to a binder to be used and a polyvinyl alcohol, gelatin, polyvinylpyrrolidone, cellulose derivative or the like may be used corresponding to the system. Among these compounds, a gelatin is suitable to recording materials for medical diagnosis which needs forming a clear image extending into details, because an aqueous solution containing the gelatin has fluidity at high temperatures but loses fluidity and is gelled at low temperatures (e.g., 35° C. or less), exhibiting high gelling qualities (setting characteristics), to thereby efficiently prevent two neighboring layers from being mixed with each other both in a method in which plural layers are applied sequentially and dried and in a method in which plural layers are applied as a multilayer at a time by using an extrusion die system or the like and dried, when coating solutions for forming plural layers on a substrate are applied and dried to form the foregoing layer, with the result that the surface condition of the resulting heat-sensitive recording material is bettered and a heat-sensitive recording material which can form a high quality image can be obtained. Further, the surface condition is not impaired even if the surface is dried at high air rate and production efficiency is therefore improved.

As such a gelatin, an unmodified (untreated) gelatin or a modified (treated) gelatin are both used without any trouble. Examples of the modified gelatin include a lime-treated gelatin, acid-treated gelatin, phthalide-treated gelatin, deionization-treated gelatin and oxygen-treated low molecular gelatin. Various surfactants may also be added to impart coatability. Also, to more improve gas barrier characteristics, inorganic microparticles such as mica may be added to the binder in an amount of 2 to 20% by weight and more preferably 5 to 10% by weight. The concentration of the binder contained in the intermediate layer coating solution is 3 to 25% by weight and preferably 5 to 15% by weight. Also, the dry amount of the intermediate layer to be coated is preferably 0.5 to 6 g/m$^2$ and more preferably 1 to 4 g/m$^2$.

Undercoat Layer

In the heat-sensitive recording material of the invention, an undercoat layer may be disposed on the substrate before the heat-sensitive recording layer containing microcapsules and the like and a photo-reflection preventive layer are applied for the purpose of preventing the heat-sensitive recording layer from being peeled off from the substrate. As the undercoat layer, an acrylate copolymer, polyvinylidene chloride, SBR and aqueous polyester may be used. The thickness of the layer is preferably 0.05 to 0.5 μm.

When the heat-sensitive recording layer is applied to the undercoat layer, there is the case where the undercoat layer is swelled in water contained in the heat-sensitive recording layer coating solution and an image recorded in the heat-sensitive recording layer is impaired. Therefore, the undercoat layer is preferably hardened using a hardener such as dialdehydes, e.g., glutaraldehyde and 2,3-dihydroxy-1,4-dioxane and boric acid. As to the amount of these hardeners to be added, a proper amount may be selected from a range of 0.2 to 3.0% by weight in accordance with a desired hardness corresponding to the weight of the undercoat raw material.

Ultraviolet Filter Layer

In the heat-sensitive recording material of the invention, a light-cutoff layer may be disposed to prevent color fading caused by light and background fogging. The light-cutoff layer is produced by dispersing a ultraviolet absorber uniformly in a binder. This uniformly dispersed ultraviolet absorber effectively absorbs ultraviolet light to thereby prevent the background from being deteriorated in color and an image portion from being deteriorated in color or fading by ultraviolet light. As a method of forming the light-cutoff layer and compounds to be used, besides ultraviolet absorbers such as a benzotriazole type, benzophenone type and hindered amine type, those described in JP-A No. 4-197778 may be utilized.

Back Layer

The heat-sensitive recording material in the invention is preferably a one-side sensitive material which is provided with a heat-sensitive recording layer on one surface of a substrate and with a back layer on the other surface. A matting went is preferably added to the back layer for the purpose of imparting transporting ability and preventing light reflection. It is preferable to decrease the bossiness measured at light-incident angle of 20° to 50% or less and more preferably 30% or less by the addition of the matting agent. Examples of the matting agent include, besides microparticles of starches obtained from barley, wheat, corn, rice, beans and the like, microparticles of synthetic polymers such as cellulose fibers, polystyrene resins, epoxy resins, polyurethane resins, urea formalin resins, poly(meth)acrylate resins, polymethyl(meth)acrylate resins, vinyl chloride resins or copolymer resins of, for example, vinyl acetate, and polyolefins and microparticles of inorganic materials such as calcium carbonate, titanium oxide, kaolin, smectite clay, aluminum hydroxide, silica and zinc oxide.

The average particle diameter of the matting agent is preferably in a range from 0.5 to 20 μm and more preferably in a range from 0.5 to 10 μm. The matting agents may be used either singly or in combinations of two or more. The matting agent preferably has a refractive index ranging from 1.4 to 1.8 from the viewpoint of bettering the transparency of the heat-sensitive recording material. In the back layer, various dyes (e.g., C.I. Pigment Blue 60, C.I. Pigment Blue 64 and C.I. Pigment Blue 15:6) may be used from the viewpoint of improving a hue. A hardener may be used in the back layer. As to examples of the hardener, there is each method described in T. H. James "THE THEORY OF THE PHOTOGRAPHIC PROCESS 4$^{TH}$ EDITION" pp.77–87 and vinylsulfone type compounds are desirable.

Method of Producing a Heat-Sensitive Recording Material

The method of producing the heat-sensitive recording material of the invention will be hereinafter explained. In the method of producing the heat-sensitive recording material of the invention, a heat-sensitive recording layer coating solution is applied to a substrate to form a heat-sensitive recording layer and a protective layer forming coating solution is applied to the heat-sensitive recording layer to form a protective layer. Further, other layers are formed as needed. Here, the heat-sensitive recording layer and the protective layer may be formed simultaneously. In this case, when the heat-sensitive recording layer is formed, the protective layer can be formed thereon at the same time.

As the substrate used here, the already explained substrate which is to be used in the heat-sensitive recording material of the invention may be used. Also, as the heat-sensitive recording layer-forming coating solution, the above-mentioned heat-sensitive recording layer-forming solution may be used. As the protective layer-forming coating solution, the aforementioned protective layer coating solution containing a pigment and a binder may be used. Also, examples of the other layers include other layers such as the aforementioned undercoat layer, intermediate layer, ultraviolet filter layer and back layer.

The heat-sensitive recording material of the invention may be applied using any method. Specifically, various coating operations are used which include extrusion coating, slide coating, curtain coating, knife coating, dip coating, flow coating or extrusion coating using a hopper of the type described in U.S. Pat. No. 2,681,294. Among these coating methods, the extrusion coating and slide coating described in Stephen F. Kistler, Petert M. Schwaizer "LIQUID FILM COATING" (published by CHAPMAN & HALL, 1997) pp.399–536 are preferably used and slide coating is particularly preferably used. Examples of the shape of a slide coater to be used in the slide coating are described in the same document, page 427, FIG. 11b.1. Two or more layers can be applied at the same time as needed by using the method described in the same document, pp.399–536 or the method described in U.S. Pat. No. 2,761,791 or U.K. Patent No. 837095. As to the drying, each coating solution is dried using dry air at a dry-bulb temperature of 20 to 65° C. and preferably 25 to 55° C. and a wet-bulb temperature of 10 to 30° C. and preferably 15 to 25° C.

Thermal Head

A thermal head to be used in the heat-sensitive recording system according to the invention is obtained by disposing a heating element doubling as a heating resistance and as an electrode and a protective layer on a gulose layer by using a known filming device such that the ratio of carbon contained in the outermost layer which is in contact with the heat-sensitive recording material is 90% or more. Although the head protective layer may be formed of two or more layers, it is necessary that the ratio of carbon contained in at least the outermost layer is 90% or more.

EXAMPLES

The present invention will be explained in more detail by way of examples, which are not intended to be limiting of the invention, in which all designations of concentration indicate % by weight. Also, the emulsion dispersion means an oil-in-water dispersed type dispersion.

Example 1

Preparation of a Protective Layer Coating Solution

Preparation of a Protective Layer Pigment Dispersion 30 g of aluminum hydroxide treated with stearic acid (trade name: HIGILITE H42S, manufactured by SHOWA DENKO K.K.) was added as a pigment to 110 g of water and the mixture was stirred for 3 hours. To the mixture were then added 0.8 g of a dispersing adjuvant (trade name: Poise 532A, manufactured by Kao Corporation), 30 g of an aqueous 10% polyvinyl alcohol solution (trade name: PVA105, manufactured by Kuraray Co., Ltd.) and 10 g of an aqueous solution containing a compound represented by the following structural formula [100] and adjusted to a concentration of 2%. The resulting mixture was dispersed using a sand mill to obtain a protective layer pigment dispersion having an average particle diameter of 0.30 μm.

Incidentally, as the "average particle diameter", an average particle diameter of pigment particles corresponding to 50% by volume of all pigments which particle diameter is measured by the following method is used: a pigment to be used is dispersed in the presence of a dispersing adjuvant, the pigment dispersion just after dispersed is diluted to a concentration of 0.5% by adding water to obtain a sample solution, which is then poured into 40° C. warm water to adjust the light transmittance to 75±1.0%, thereafter subjected to ultrasonic treatment for 30 seconds and then subjected to measurement using a laser diffraction grain distribution measuring device (trade name: LA700, manufactured by Horiba, Ltd.). All designations of the "average particle diameter" described hereinbelow indicates an average particle diameter measured by the same method.

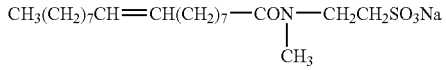

[100]

Preparation of a Protective Layer Coating Solution

The following materials were mixed with 65 g of water to obtain a protective layer coating solution.

| | |
|---|---|
| Aqueous 8% polyvinyl alcohol solution (trade name: PVA124C, manufactured by Kuraray Ltd.) | 90 g |
| 20.5% zinc stearate dispersion (trade name: F115, manufactured by Chukyo Oil & Fat Co., Ltd.) | 5.5 g |
| 21.5% stearic acid amide compound (trade name: G-270, manufactured by Chukyo Oil & Fat Co., Ltd.) | 3.8 g |
| 18.0% stearic acid dispersion (trade name: Cellosol 920, manufactured by Chukyo Oil & Fat Co., Ltd.) | 2.8 g |
| Aqueous 4% boric acid solution | 10 g |
| Protective layer pigment dispersion mentioned above | 70 g |
| Water dispersion of 35% silicone oil (polydimethylsiloxane, trademark: BY22-840, manufactured by Dow Corning Toray Silicone Co., Ltd.) | 4.7 g |
| Aqueous 10% sodium dodecylbenzenesulfonate solution | 6.5 g |
| Aqueous 75% ammonium di-2-ethylhexylsulfosuccinate solution (trade name: Nissan Electol SAL1, manufactured by Nippon Oil & Fats Co., Ltd.) | 3.28 g |
| Aqueous 6% styrene/maleic acid copolymer ammonium salt solution (trade name: Polymalon 385, manufactured by Arakawa Chemical Industries, Ltd.) | 17.5 g |
| 20% Colloidal silica (trade name: Snowtex, manufactured by Nissan Chemical Industries, Ltd.) | 14 g |
| 10% Fluorine-based surfactant (trade name: Surflon S131S, manufactured by Asahi Glass Company) | 16 g |
| Alkylphosphate ester surfactant (trade name: Plysurf A217E, manufactured by Dai-ichi Kogyo Seiyaku Co., Ltd.) | 1.1 g |
| 2% Acetic acid | 8 g |

Preparation of an Intermediate Layer Coating Solution 7848 g of water was added to 1 kg of a gelatin treated with lime to dissolve the gelatin. Then, 137 g of a 5% solution (mixed solution of water/methanol=1/1 by volume) of sodium di-2-ethylhexylsulfosucciinate solution (trade name:

Nissan Lapisol B90, manufactured by Nippon Oil & Fats Co., Ltd.) was added to the mixture to prepare an intermediate layer coating solution.

Preparation of a Heat-Sensitive Recording Layer Coating Solution

Each solution of microcapsule coating solutions and developer emulsion dispersants were prepared in the following manner.

Preparation of a Microcapsule Coating Solution A

The following compounds were added as color couplers to 24.3 g of ethyl acetate.

| | |
|---|---|
| Compound represented by the following structural formula [201] | 11.7 g |
| Compound represented by the following structural formula [202] | 1.5 g |
| Compound represented by the following structural formula [203] | 2.2 g |
| Compound represented by the following structural formula [204] | 5.65 g |
| Compound represented by the following structural formula [205] | 1.2 g |
| Compound represented by the following structural formula [206] | 1.1 g |
| Compound represented by the following structural formula [207] | 0.57 g |

The mixture was heated to 70° C. to dissolve these compounds and then cooled to 45° C. To the mixture was added 15.4 g of a capsule wall material (trade name: Takenate D140N, manufactured by Mitsui Takeda Chemical Co., Ltd.), followed by mixing.

[201]

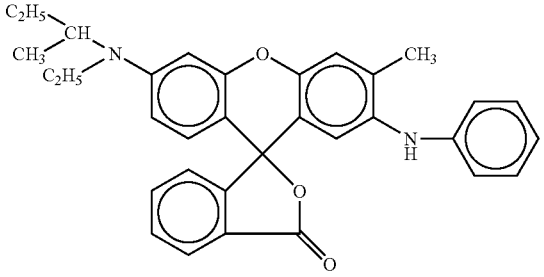

[202]

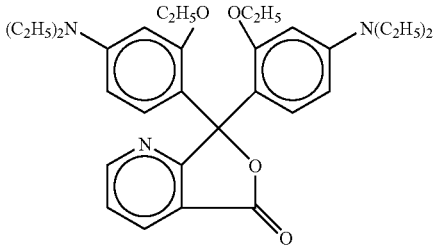

[203]

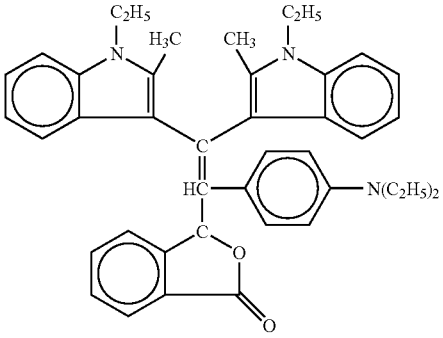

-continued

[204]

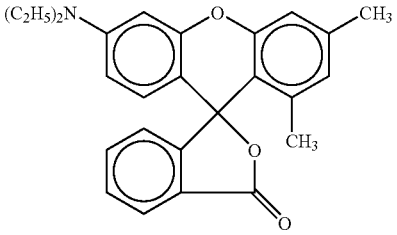

[205]

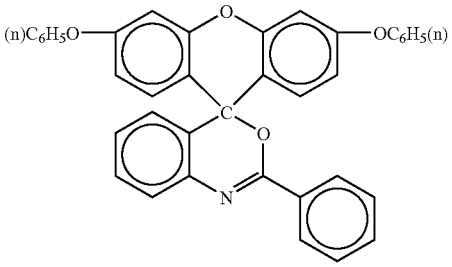

[206]

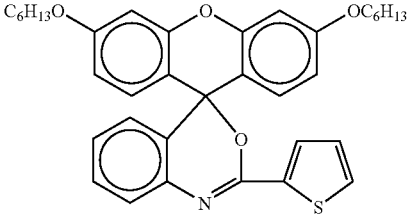

[207]

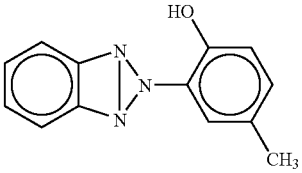

This solution was added to a water-phase obtained by mixing 48 g. of an aqueous 8% polyvinyl alcohol solution (trade name: MP-103, manufactured by Kuraray) with 16 g of water. The mixture was emulsified for 5 minutes at a rotation of 15000 rpm by using a Ace Homogenizer (trade name: manufactured by Nippon Seiki Co., Ltd.). To the resulting emulsion were further added 110 g of water and 1.0 g of tetraethylenepentamine. The resulting mixture was subjected to a capsulation reaction run at 60° C. for 4 hours to prepare a microcapsule coating solution A having an average particle diameter of 0.80 μm.

The glass transition temperature (hereinafter called Tg) of the resulting capsule wall of the microcapsule solution was measured using a DMTA (Dynamic Mechanical Thermal Analyzer) (trademark of a glass transition temperature gage manufactured by Polymer Laboratory) to find that it was 193° C.

Preparation of a Microcapsule Coating Solution B

The following compounds were added to 21 g of ethyl acetate.

| | |
|---|---|
| Compound represented by the following structural formula [201] | 12.2 g |
| Compound represented by the following structural formula [202] | 1.6 g |
| Compound represented by the following structural formula [203] | 2.4 g |
| Compound represented by the following structural formula [204] | 3.3 g |

-continued

| | |
|---|---|
| Compound represented by the following structural formula [205] | 1.5 g |
| Compound represented by the following structural formula [206] | 0.2 g |
| Compound represented by the following structural formula [207] | 0.5 g |

The mixture was heated to 70° C. to dissolve these compounds and then cooled to 35° C. To the mixture was added 16.6 g of a capsule wall material (trade name: Takenate D127N, manufactured by Mitsui Takeda Chemical Co., Ltd.) and mixed.

This solution was added to a water-phase obtained by mixing 48.1 g of an aqueous 8% polyvinyl alcohol solution (trade name: MP-103, manufactured by Kuraray) with 16.6 g of water. The mixture was emulsified for 5 minutes at a rotation of 15000 rpm by using a Ace Homogenizer (trade name: manufactured by Nippon Seiki Co., Ltd.). To the resulting emulsion were further added 112 g of water and 0.9 g of tetraethylenepentamine. The resulting mixture was subjected to a capsulation reaction run at 60° C. for 4 hours to prepare a microcapsule coating solution B having an average particle diameter of 0.30 μm.

Tg of the resulting capsule wall of the microcapsule solution B was measured in the same manner as in the preparation of the microcapsule solution A to find that it was 153° C.

Preparation of a Developer Micro Emulsion Dispersion

The following compounds were added as developers to 16.5 g of ethyl acetate together with 1.0 g of tricresyl phosphate and 0.5 g of diethyl maleate.

| | |
|---|---|
| Compound represented by the following structural formula [301] | 6.7 g |
| Compound represented by the following structural formula [302] | 8.0 g |
| Compound represented by the following structural formula [303] | 5.8 g |
| Compound represented by the following structural formula [304] | 1.5 g |
| Compound represented by the following structural formula [305] | 2.2 g |
| Compound represented by the following structural formula [306] | 0.8 g |
| Compound represented by the following structural formula [307] | 4.3 g |

The mixture was heated to 70° C. to dissolve these compounds.

[301]

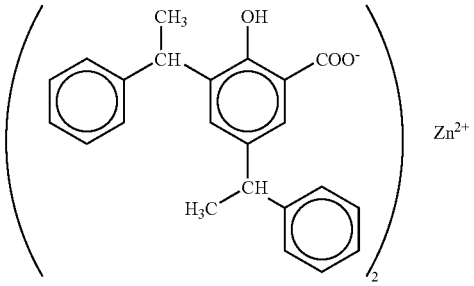

[302]

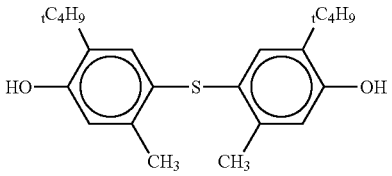

-continued

[303]

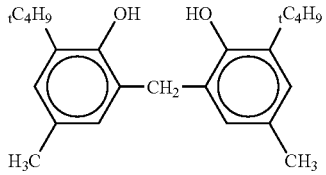

[304]

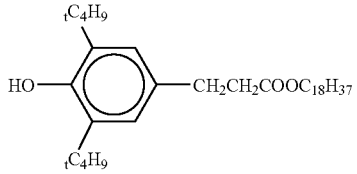

[305]

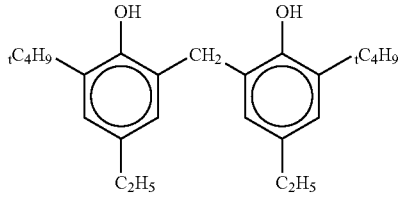

[306]

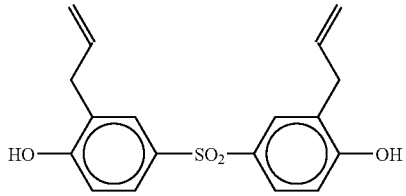

[307]

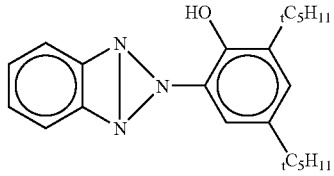

This solution was added to a water-phase obtained by mixing 70 g of water, 57 g of an aqueous 8% polyvinyl alcohol solution (trade name: PVA217C, manufactured by Kuraray), 20 g of an aqueous 15% polyvinyl alcohol solution (trade name: PVA205C, manufactured by Kuraray) and 11.5 g of an aqueous 2% solution of the compound represented by the following structural formula [401] and the compound represented by the following structural formula [402]. The mixture was then emulsified at a rotation of 10000 rpm by using a Ace Homogenizer (trade name: manufactured by Nippon Seiki Co., Ltd.) such that the average particle diameter was 0.7 μm to obtain a developer emulsion dispersion C.

[401]

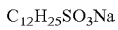

[402]

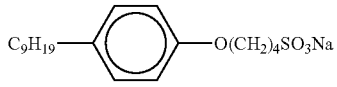

Preparation of a Heat-Sensitive Recording Layer Coating Solution A

The following materials were mixed to prepare a heat-sensitive recording coating solution A.

| | |
|---|---|
| Microcapsule coating solution A obtained above (solid concentration: 23%) | 12 g |
| Microcapsule coating solution B (solid concentration: 24%) | 2.5 g |
| Developer emulsion dispersion C obtained above (solid concentration: 22%) | 50 g |
| Aqueous 50% solution of the compound represented by the following structural formula [403] | 0.7 g |
| Colloidal silica (Snowtex, manufactured by Nissan Chemical Industries, Ltd.) | 1.8 g |

[403]

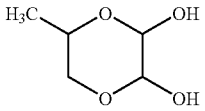

Preparation of a Heat-Sensitive Recording Layer Coating Solution B

The following materials were mixed to prepare a heat-sensitive recording coating solution B.

| | |
|---|---|
| Microcapsule coating solution A (solid concentration: 23%) | 2.3 g |
| Microcapsule coating solution B (solid concentration: 24%) | 6.6 g |
| Developer emulsion dispersion C (solid concentration: 22%) | 33 g |
| Colloidal silica (Snowtex, manufactured by Nissan Chemical Industries, Ltd.) | 1.5 g |
| Aqueous 50% solution of the compound represented by the following structural formula [403] | 0.4 g |

Preparation of a Back Layer Coating Solution A

Water was added to 1 kg of a gelatin treated with lime, 757 g of a gelatin dispersion containing 12% of a PMMA particle having an average particle diameter of 5.7 μm, 3761 g of an emulsion of a ultraviolet absorber containing the compounds represented by the structural formulae [501] to [505] in the following contents (contents of the ultraviolet absorbers per 1 kg of the emulsion);

| | |
|---|---|
| Compound represented by the structural formula [501] | 9.8 g |
| Compound represented by the structural formula [502] | 8.4 g |
| Compound represented by the structural formula [503] | 9.8 g |
| Compound represented by the structural formula [504] | 13.98 g |
| Compound represented by the structural formula [505] | 29.3 g |
| and 1,2-benzisothiazoline-3-one | 1.75 g |
| Poly(sodium p-vinylbenzenesulfonate) (molecular weight: about 400000) | 64.2 g |
| Compound represented by the structural formula [506] | 10.0 g |
| Latex 20% solution of a polyethylacrylate | 3180 ml |
| N,N-ethylenebis(vinylsulfonylacetamido) | 75.0 g |
| 1,3-bis(vinylsulfonylacetamido)propane | 25.0 g |
| to be a total volume of 62.77 l | |

[0501]

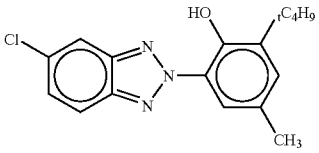

-continued

[0502]

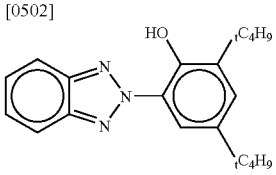

[0503]

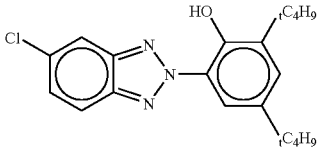

[0504]

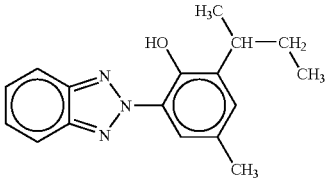

[0505]

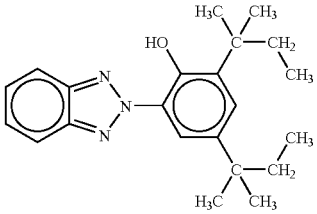

[0506]

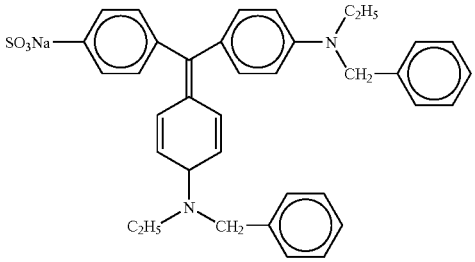

Preparation of a Back Layer Coating Solution B 1 kg of a gelatin treated with lime, 2000 g of a gelatin dispersion containing 12% of a spherical PMMA particle having an average particle diameter of 0.7 μm, 1268 ml of methanol, 1.75 g of 1,2-benzisothiazoline-3-one, 64.4 g of sodium polyacrylate (molecular weight: about 100000), 54 g of poly(sodium p-vinylbenzenesulfonate)(molecular weight; about 400000), 25.2 g of sodium p-tert-octylphenoxypolyroxyethylene-sodium ethylenesulfonate, 5.3 g of sodium N-propyl-N-polyethylene-perfluorooctanesulfonic acid amidobutylsulfonate and 7.1 g of potassium perfuorooctanesulfonate were adjusted to pH 7.0 by adding caustic soda and water was added to the mixture to be a total volume of 66.79 l.

The foregoing back layer coating solution A and back layer coating solution B were laminated at the same time on one surface of a 180 μm-thick biaxial oriented polyethylene terephthalate substrate, dyed blue (x=0.2850, y=0.2995 in a chromaticity coordinate), by application using a slide beads method in this order from the side close to the substrate such that the coating amounts of the solutions A and B were 44.0 ml/m$^2$ and 18.5 ml/m$^2$ respectively, followed by drying.

The application and drying conditions were as follows. The coating speed was designed to be 160 m/min, the interval between the distal end of coating die and the substrate was designed to be 0.10 to 0.30 mm and the pressure in the vacuum chamber was set to a pressure lower by 200 to 1000 Pa than the atmosphere. The substrate was de-electrified using ionic wind prior to coating. In the subsequent chilling zone, the coating solution was cooled using air having a dry-bulb temperature of 0 to 20° C. and then conveyed in a contactless state to a helical type contactless drier where it was dried using dry air having a dry-bulb temperature of 23 to 45° C. and a wet-bulb temperature of 15 to 21° C.

Production of a Heat-Sensitive Recording Material

The heat-sensitive color developing layer coating solutions A and B, the intermediate layer coating solution and the protective layer coating solution were applied to the surface of the substrate coated with the back layer on the side opposite to the back layer in this order from the side close to the substrate such that the coating amounts were 50 ml/m$^2$, 20 ml/m$^2$, 27 ml/m$^2$ and 25 ml/m$^2$ respectively, followed by drying to obtain a transparent heat-sensitive recording material of Example 1.

Example 2

A microcapsule coating solution C was prepared using "12.3 g of a capsule wall material (trade name: Takenate D110N, manufactured by Mitsui Takeda Chemical Co., Ltd.) and 3.1 g of a capsule wall material (trade name: Barnock D750, manufactured by Dainippon Ink and Chemicals Incorporated) in place of "15.4 g of the capsule wall material (trade name: Takenate D140N, manufactured by Mitsui Takeda Chemical Co., Ltd.)" used in the microcapsule coating solution A of Example 1. Tg of the capsule wall of the resulting microcapsule coating solution C was measured in the same manner as in the preparation of the microcapsule coating solution A, to find that it was 185° C. Heat-sensitive coating solutions A and B were prepared afterward in the same manner as in Example 1 except that the microcapsule coating solution C was used in place of the microcapsule coating solution A in Example 1, to prepare a heat-sensitive recording material of Example 2.

Example 3

A microcapsule coating solution D was prepared using a "12.3 g of a capsule wall material (trade name: Takenate D110N, manufactured by Mitsui Takeda Chemical Co., Ltd.) and 3.1 g of a capsule wall material (trade name: Sumidule N3200, manufactured by Sumitomo Bayer Urethane Co., Ltd.) in place of "16.6 g of a capsule wall material (trade name: Takenate D127N, manufactured by Mitsui Takeda Chemical Co., Ltd.)" used in the microcapsule coating solution B of Example 1. Tg of the capsule wall of the resulting microcapsule coating solution D was measured in the same manner as in the preparation of the microcapsule coating solution A, to find that it was 128° C. Heat-sensitive coating solutions A and B were prepared afterward in the same manner as in Example 1 except that the microcapsule coating solution D was used in place of the microcapsule coating solution B in Example 1, to prepare a heat-sensitive recording material of Example 3.

Example 4

A heat-sensitive coating solution C was prepared using "4.0 g of the microcapsule coating solution A and 4.0 g of the microcapsule coating solution B" were used in place of "2.3 g of the microcapsule coating solution A and 6.6 g of the microcapsule coating solution B" used in the preparation of the heat-sensitive coating solution B of Example 1. A heat-sensitive recording material of Example 4 was obtained in the same manner as in Example 1 except that the heat-sensitive coating solution C was used in place of the heat-sensitive coating solution B used in Example 1.

Example 5

A microcapsule coating solution B1 having an average particle diameter of 0.40 μm was prepared in the same manner as in Example 1, except that in preparation of the heat-sensitive recording layer coating solution in Example 1, the number of revolutions of the Ace homogenizer employed in preparation of the microcapsule coating solution B was changed from 15,000 rpm to 12,000 rpm. Tg of the capsule wall of the obtained microcapsule coating solution B1 was measured in a similar manner to microcapsule coating solution A and found to be 193° C.

A heat-sensitive recording material of Example 5 was obtained in the same manner as in Example 1 by preparing the heat-sensitive recording layer coating solutions A and B, except that the microcapsule coating solution B was changed to the microcapsule coating solution B1.

Example 6

A microcapsule coating solution A1 having an average particle diameter of 0.90 μm was prepared in the same manner as in Example 1, except that in preparation of the heat-sensitive recording layer coating solution in Example 1, the number of revolutions of the Ace homogenizer employed in preparation of the microcapsule coating solution A was changed from 10,000 rpm to 8,000 rpm. Tg of the capsule wall of the obtained microcapsule coating solution A1 was measured in a similar manner to microcapsule coating solution A and found to be 193° C.

A heat-sensitive recording material of Example 6 was obtained in the same manner as in Example 1 by preparing the heat-sensitive recording layer coating solutions A and B, except that the microcapsule coating solution A was changed to the microcapsule coating solution A1.

Comparative Example 1

Heat-sensitive coating solutions A and B were prepared and applied in the same manner as in Example 1 except that the microcapsule coating solution A was only used in the preparation of the heat-sensitive coating solutions A and B used in Example 1, to obtain a heat-sensitive recording material of Comparative Example 1.

Comparative Example 2

Heat-sensitive coating solutions A and B were prepared and applied in the same manner as in Example 1 except that the microcapsule coating solution B was only used in the preparation of the heat-sensitive coating solutions A and B used in Example 1, to obtain a heat-sensitive recording material of Comparative Example 2.

Evaluation of Heat-Sensitivity

With regard to the obtained heat-sensitive recording materials of Examples 1 to 4 and Comparative Examples 1 and 2, the transmission density of each image portion in the case of recording an image by using a thermal printer TRT-16 (trade name: manufactured by Nagano Japan Radio Co., Ltd.) with changing heat energy applied to a thermal head was measured using a Macbeth densitometer (trade name. TD-904, manufactured by Macbeth).

Evaluation of Gradation

In order to evaluate the gradation from the transmission density of each resulting image portion, heat energy to be applied at a transmission density of 1.0 to 1.5 was found to thereby find a change γ in density (=difference in density ΔD/difference in sensitivity ΔLog E) as a function of the heat energy to be applied. The results are shown in Table 1.

TABLE 1

| | Microcapsule High Tg | | Microcapsule Low Tg | | Heat-sensitive recording layer Microcapsule Structural Ratio (% by mass) | | | | Applied Energy at image | Applied Energy at image | Change In |
|---|---|---|---|---|---|---|---|---|---|---|---|
| | | Partcle | | Partcle | | | | | | | |
| | Tg | Diameter | Tg | Diameter | Layer A | | Layer B | | Density 1.0 | Density 1.5 | Density γ |
| | (° C.) | (μm) | (° C.) | (μm) | High Tg | Low Tg | High Tg | Low Tg | (mi/mm$^2$) | (mj/mm2) | |
| Example 1 | 193 | 0.80 | 153 | 0.30 | 82.1 | 17.9 | 25 | 75 | 74.9 | 85.6 | 8.5 |
| Example 2 | 185 | 0.80 | 153 | 0.30 | 82.1 | 17.9 | 25 | 75 | 75.7 | 86.9 | 9.0 |
| Example 3 | 193 | 0.80 | 128 | 0.30 | 82.1 | 17.9 | 25 | 75 | 77.6 | 88.8 | 8.3 |
| Example 4 | 193 | 0.80 | 153 | 0.30 | 82.1 | 17.9 | 48.9 | 51.1 | 76.0 | 87.5 | 8.4 |
| Example 5 | 193 | 0.80 | 153 | 0.40 | 82.1 | 17.9 | 25 | 75 | 79.0 | 90.5 | 8.6 |
| Example 6 | 193 | 0.90 | 153 | 0.30 | 82.1 | 17.9 | 25 | 75 | 79.0 | 91.0 | 8.3 |
| Com. Example 1 | 193 | 0.80 | | | 100 | | 100 | | 91.6 | 100.5 | 12.4 |
| Com. Example 2 | | | 153 | 0.30 | | 100 | | 100 | 71.0 | 77.5 | 13.0 |

The heat-sensitive recording materials of Examples 1 to 6 provided with heat-sensitive recording layers differing in the structural ratio of microcapsules having different glass transition temperatures or different volume average particle diameters according to the invention has a smaller change in density as a factor of applied energy as compared with the comparative examples, showing that these materials are superior in the expression of the gradation of an image.

The heat-sensitive recording material according to the invention which is made of two or more microcapsules having different glass transition temperatures or different volume average particle diameters and where two or more layers are disposed as the heat-sensitive recording layer containing the microcapsules is superior in the expression of the gradation of an image and is therefore preferably used as heat-sensitive recording materials for medical use.

What is claimed is:

1. A heat-sensitive recording material comprising a support having disposed thereon a heat-sensitive recording layer including microcapsules in which an electron-donating dye precursor is encapsulated and outside which an electron-accepting compound is present, the electron-donating dye precursor being capable of reacting with the electron-accepting compound to develop color, wherein the microcapsules comprise at least two kinds of microcapsules having different volume average particle diameters.

2. The heat-sensitive recording material according to claim 1, which comprises two or more heat-sensitive recording layers each including at least two kinds of microcapsules having different volume average particle diameters.

3. The heat-sensitive recording material according to claim 2, wherein the difference in volume average particle diameter between the at least two kinds of microcapsules is 0.3 to 0.7 μm.

4. The heat-sensitive recording material according to claim 2, which comprises a heat-sensitive recording layer whose mass ratio (x/y) of a microcapsule (x) having a larger volume average particle diameter to another microcapsule (y) having a smaller volume average particle diameter is 85/15 to 55/45 and another heat-sensitive recording layer whose mass ratio (x/y) is 20/80 to 50/50.

5. The heat-sensitive recording material according to claim 2, wherein the electron-donating dye precursor is selected from the group consisting of phthalide compounds, fluoran compounds, phenothiazine compounds, leucoauramine compounds, rhodamine lactam compounds, triphenylmethane compounds, triazene compounds, spirodipyran compounds, pyridine compounds, pyrazine compounds and fluorene compounds.

6. The heat-sensitive recording material according to claim 2, wherein the electron-accepting compound is selected from the group consisting of phenol derivatives, salicylic acid derivatives, metal salts of aromatic carboxylic acids, acid china clay, bentonite, novolak resin, metal-treated novolak resin, and metal complexes.

7. The heat-sensitive recording material according to claim 2, wherein the electron-accepting compound is contained in a ratio of 50 to 800% by mass relative to the electron-donating dye precursor.

8. The heat-sensitive recording material according to claim 2, wherein the heat-sensitive recording layer further comprises at least one member selected from the group consisting of a hot-melt material, a UV absorbent, a pigment, a sensitizer, a wax, an antistatic agent, a defoaming agent, an electroconductive agent, a fluorescent dye, a surfactant and a UV absorbent precursor.

9. The heat-sensitive recording material according to claim 2, wherein the heat-sensitive recording layer has a transmittance density (Dt-max) of 3.0 at a heat energy range of 90 to 150 mJ/mm$^2$.

10. The heat-sensitive recording material according to claim 2, wherein the support comprises polyethylene terephthalate.

11. The heat-sensitive recording material according to claim 1, wherein the difference in volume average particle diameter between the at least two kinds of microcapsules is 0.3 to 0.7 μm.

12. The heat-sensitive recording material according to claim 1, which comprises at least a heat-sensitive recording layer whose mass ratio (x/y) of a microcapsule (x) having a larger volume average particle diameter to another microcapsule (y) having a smaller volume average particle diameter is 85/15 to 55/45 and another heat-sensitive recording layer whose mass ratio (x/y) is 20/80 to 50/50.

13. The heat-sensitive recording material according to claim 1, wherein the electron-donating dye precursor is selected from the group consisting of phthalide compounds, fluoran compounds, phenothiazine compounds, leucoauramine compounds, rhodamine lactam compounds, triphenylmethane compounds, triazene compounds, spirodipyran compounds, pyridine compounds, pyrazine compounds and fluorene compounds.

14. The heat-sensitive recording material according to claim 1, wherein the electron-accepting compound is selected from the group consisting of phenol derivatives, salicylic acid derivatives, metal salts of aromatic carboxylic acids, acid china clay, bentonite, novolak resin, metal-treated novolak resin, and metal complexes.

15. The heat-sensitive recording material according to claim 1, wherein the electron-accepting compound is contained in a ratio of 50 to 800% by mass relative to the electron-donating dye precursor.

16. The heat-sensitive recording material according to claim 1, wherein the heat-sensitive recording layer further comprises at least one member selected from the group consisting of a hot-melt material, a UV absorbent, a pigment, a sensitizer, a wax, an antistatic agent, a defoaming agent, an electroconductive agent, a fluorescent dye, a surfactant and a UV absorbent precursor.

17. The heat-sensitive recording material according to claim 1, wherein the heat-sensitive recording layer has transmittance density Dt-max) of 3.0 at a heat energy range of 90 to 150 $mJ/mm^2$.

18. The heat-sensitive recording material according to claim 1, further comprising a protective layer on the heat-sensitive recording layer.

19. The heat-sensitive recording material according to claim 18, wherein the protective layer comprises a pigment selected from the group consisting of kaolin, aluminum hydroxide and amorphous silica.

20. The heat-sensitive recording material according to claim 1, wherein the support comprises polyethylene terephthalate.

* * * * *